United States Patent [19]

Evans

[11] Patent Number: 4,999,607

[45] Date of Patent: Mar. 12, 1991

[54] MONITORING SYSTEM WITH IMPROVED ALERTING AND LOCATING

[75] Inventor: Wayne W. Evans, Roswell, Ga.

[73] Assignee: Biotronics Enterprises, Inc., Norcross, Ga.

[21] Appl. No.: 322,616

[22] Filed: Mar. 13, 1989

Related U.S. Application Data

[63] Continuation of Ser. No. 129,158, Dec. 7, 1987, abandoned.

[51] Int. Cl.[5] ..... G08B 1/08

[52] U.S. Cl. ..... 340/533; 340/531; 340/539; 340/537; 340/538

[58] Field of Search ..... 340/533, 531, 539, 506, 340/505, 537, 538, 310 R, 310 A, 310 CP

[56] References Cited

U.S. PATENT DOCUMENTS

| | | | |
|---|---|---|---|
| 3,925,763 | 12/1975 | Wadhwani et al. | 340/539 |
| 3,927,404 | 12/1975 | Cooper | 340/533 |
| 4,535,401 | 8/1985 | Penn | 340/505 |
| 4,562,428 | 12/1985 | Harman et al. | 340/531 |
| 4,622,541 | 11/1986 | Stockdale | 340/506 |
| 4,672,310 | 6/1987 | Sayed | 340/644 |
| 4,742,334 | 5/1988 | Teich et al. | 340/505 |

OTHER PUBLICATIONS

Digital Slave Communication; Digital Central Stations; and Emergency Aid Products-Product Information Sheets by Sescoa; 4-1988.

CMOD Manchester Encoder-Decoder HD-155-30-Harris Product Information Sheets, 4-1988.

Supertex Inc.—Programmable Encoder/Decoder ED-5, ED-9, ED-11, ED-15; Product Information Sheets—4-1988.

*Primary Examiner*—Donnie L. Crosland

*Attorney, Agent, or Firm*—Louis T. Isaf

[57] ABSTRACT

An expansive and expandable monitoring system which in one of its broadest embodiments includes a multi-sector, multi-condition monitoring system including radio linked alert monitors, smoke monitors and an expandable range of activity monitors such as door-opening monitors and toilet-flushing monitors and including method and apparatus for identifying a particular monitor within a sector; wherein each sector stands itself as a unique sub-system built about a two-wire bus on which both power identifying signals are simultaneously conveyed along the same two wires; and within each sector, the plurality of monitoring devices receive operating power from a common power source and convey identifying signals to a common discriminator (identifier) arrangement all along the common two-wire bus, each monitoring device being constructed with a unique arrangement of current modulating and signal/voltage isolation elements to facilitate the common bus—common power source—common discriminator scheme of the present invention; and wherein the system includes unique, all coded receivers including method and apparatus for accepting, encoding, conveying and decoding the coded signals of a plurality of transmitter devices.

14 Claims, 11 Drawing Sheets

MONITORING SYSTEM WITH IMPROVED ALERTING AND LOCATING

This application is a continuation of application Ser. No. 07/129,158, filed Dec. 7, 1987, now abandoned.

FIELD OF THE INVENTION

This invention relates generally to the field of monitoring and surveillance and more specifically to the monitoring and surveillance of emergency or perceived emergency conditions encountered by an individual.

BACKGROUND OF THE INVENTION

It is arguably one goal of technology to reconcile conflicting needs. One example of conflicting needs, which have been recognized as requiring reconciling are the needs of persons to have available to them emergency assistance and care while at the same time to, maintain freedom and privacy. The need for emergency assistance and the need for freedom and privacy may not always appear to conflict; however, as the need for emergency assistance or care becomes more imminent or probable, the conflict becomes more real. Examples of this real conflict are lived out daily in the lives of millions of elderly persons who, as they increase in age, become more and more dependent upon the availability of quick-responding assistance or regular care while at the same time retaining the desire and need for the freedom to move about and the privacy to lead their own lives in dignity. Other examples of these real conflicts may be witnessed in the lives of persons with medical problems which require either rapid, emergency assistance, or regular observation and care. Numerous other examples of this real conflict do exist but need not be specifically outlined here.

In its worst case scenario, the Affected Person (i.e. the elderly or medical patients) had to choose between (1) constant care and ever present assistance at the loss of freedom of movement and privacy, or (2) freedom of movement and privacy at the risk of damaging health, frightening injury and even death. The broadly defined industry of monitoring and surveilence has, over the years, provided various technological advances to lessen the harsh dichotomy of the worst case scenario. One such advance was the "nurse call" system which exists in most hospitals and nursing homes today. A problem with these nurse call systems is that they are direct-access systems which require the patient or elderly resident to move to a call button to activate the nurse call. Thus, if the person is injured and unable to move to the button, the injury goes undetected. Thus, in facilities equipped with nurse call buttons only, the Affected Person is confined to a space (i.e. bed) within reach of the call button or to an apartment or room in close proximity to the call button. There are numerous types of emergency alert systems in existence which use small radio transmitters, pendants or wristwatches to communicate with a receiver in order to help the Affected Person free himself/herself from the restricted confines of the direct-access nurse call system. The transmitter of these existing radio linked alert systems are typically coded to a particular receiver located in the room of the Affected Person, and only that receiver matches the particular transmitter. Furthermore, the transmitters typically are restricted to a 100 to 200 foot range and, thus, subject the Affected Person to the confines of a defined, limited area surrounding his/her room. It is also noted that these radio linked emergency alert systems are typically constructed such that the receiver is hard-wired back to a central phone system which dials out to another phone number using the normal phone switch system and phone lines. Thus, among other problems: if the Affected Person leaves the confines of the limited transmission area, he/she cannot communicate an emergency need using the transmitter; or if a phone in the apartment were knocked off the hook or was otherwise out-of-order the transmitter would also not work.

From the point of view of the potential care giver, such as a nursing facility, the existing, radio linked alert systems are, perhaps, less valuable than the direct-access nurse call systems since many facilities might prefer that their alert system be hard-wired to a central point which can be monitored 24 hours a day, rather than depending upon the operation and ability of telephone lines. For the benefit of such facilities, numerous hard-wired communication systems do exist. They generally take the form of a modem at each end utilizing a carrier signal with, generally, frequency shift keying type communications transferring data over a 2-wire line system similar to a telephone line. Such systems have been found to become less acceptable as the number of apartments (or rooms) within a facility increases, since the system becomes more complex and much more expensive as additional locations are added.

User activated devices such as those mentioned above, do not address circumstances where the Affected Person requires possible care due to fainting, extreme weakness, or a fall out of reach of their transmitter. In an effort to address this concern, the industry has provided "activity monitors" which indicate, for example, when a person has opened the door. In this way, a facility can know to check up on an Affected Person if there has been no indication of the monitored activity over a certain period of time. Presently, the number and type of activities which can be monitored are limited by the time and expense of wiring each and every "activity monitor" to some central point where they can all be observed on a 24-hour basis. The expense and complexity of installing all of these individual activity monitors and their related wiring render effective use of such activity monitors difficult to afford for new facilities and practically prohibitive to install as retrofit devices in existing facilities.

Matters become even more complicated, in both new and retrofit applications, if the facility desires to have both user activated monitoring devices (such as a transmitter system) and various other monitoring devices such as activity monitors. The complexity becomes, under the prior art, a seemingly overwelming task both in physical complexities and in expense.

SUMMARY OF THE INVENTION

Briefly described, the present invention comprises an expansive and expandable monitoring system which in one of its broadest embodiments comprises a multi-sector, multi-condition monitoring system including radio linked alert monitors, smoke monitors and an expandable range of activity monitors such as door-opening monitors and toilet-flushing monitors. The system of this broad embodiment divides a region into monitored sectors and each sector includes a collection of similar or dissimilar monitoring devices which the system identifies as belonging to the particular sector. In addition to being identified as belonging to a particular sector, the present invention provides method and apparatus for identifying a particular device within a sector. In one example of this embodiment of the present invention, the divided region is a high-rise residence for the elderly and each monitored sector is an apartment occupied by an elderly resident.

Within the scope of the present invention, each sector stands itself as a unique sub-system built about a two-wire bus on which both power and identifying signals are simultaneously conveyed along the same two wires.

Within each sector of one embodiment of the present invention, a plurality of monitoring devices receive operating power from a common power source and convey identifying signals to a common discriminator (identifier) arrangement, all along the common two-wire bus. Each monitoring device is constructed with a unique arrangement of current modulating and signal/-voltage isolation elements to facilitate the common bus—common power source—common discriminator scheme of the present invention.

Further, within the scope of the present invention, the system comprises unique, all-code receivers including method and apparatus for accepting, encoding, conveying and decoding the coded signals of a plurality of transmitter devices.

It is, therefore, an object of the present invention to provide a high degree of monitoring of the personal and emergency needs of an individual while, at the same time, providing a high degree of freedom of movement and personal privacy for that individual.

Another object of the present invention is to provide an expansive and expandable monitoring system which allows a caregiver facility to be alerted to the needs of an individual and to locate that individual, thus providing the ability for the individual to roam beyond the confines of his or her apartment area.

Still another object of the present invention is to provide a totally coded monitoring system with improved techniques for identifying a type of emergency condition, the identity of the person in need and/or the location of the emergency condition.

Another object of the present invention is to provide a multiple function monitoring system which finds practical installation in both new and retrofit construction.

Yet another object of the present invention is to provide a monitoring system which is expandable from a single sector, single condition monitoring system to a single sector, multi-condition monitoring system and/or to a multi-sector, multi-condition monitoring system.

Still another object of the present invention is to provide an all-code receiver capable of receiving a code from a coded radio transmitter within the vicinity of the receiver and capable of communicating that code to a processing location whereby the location and identity of one or more of a plurality of transmitters can be determined.

Still another object of the present invention is to provide a monitoring system in which a plurality of monitoring devices monitoring a plurality of prospective emergency conditions are all supported from and identified through a single, two-conductor bus.

Other objects, features and advantages of the present invention will become apparent upon reading and understanding the present specification when taken in conjunction with the accompanying drawings.

DETAILED DESCRIPTION OF PREFERRED EMBODIMENT

Figure 1:
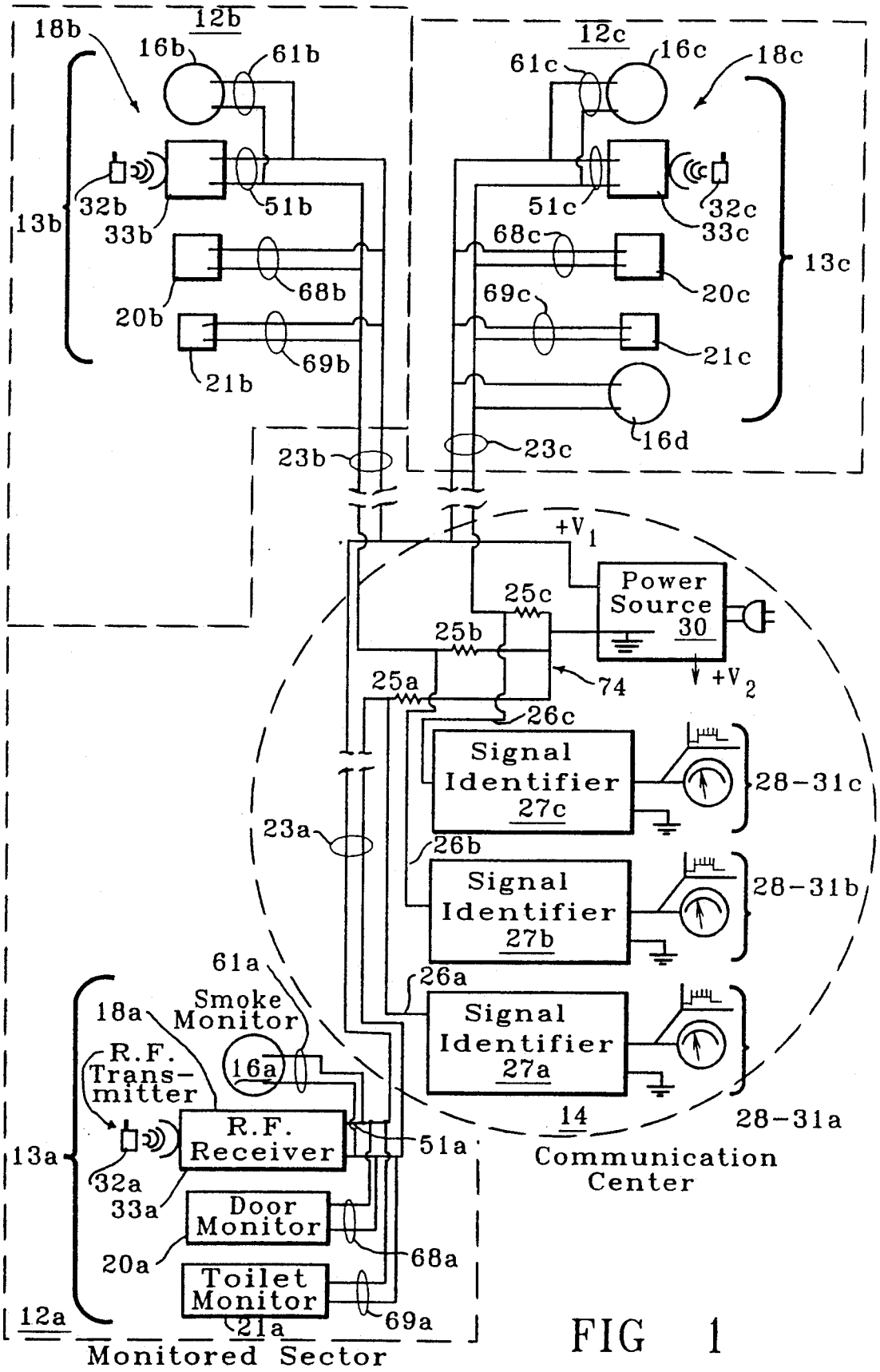
FIG. 1 is a schematic representation of multi-sector/-multi-condition embodiment of the monitoring system in accordance with the present invention.
Figure 2:
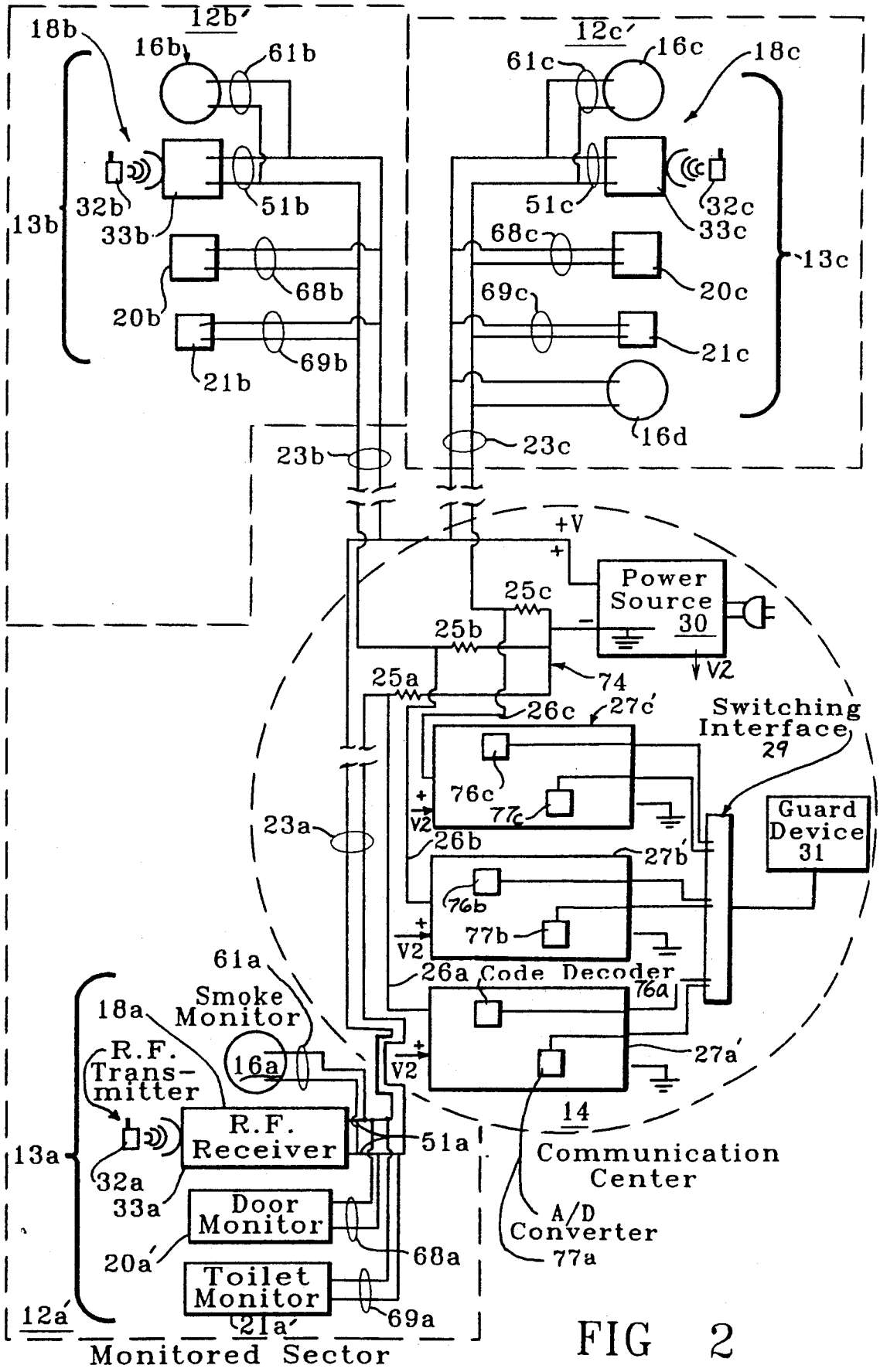
FIG. 2 is a schematic representation of the monitoring system of FIG. 1, showing an alternate embodiment thereof.

Referring now in detail to the drawings in which like numerals represent like components throughout the several views, FIG. 1 shows a representative example of a multi-sector/multi-condition embodiment of the monitoring system of the present invention. The embodiment of FIG. 1 shows three (3) monitored sectors **12*a*, 12*b*, 12*c* and a common, communication center 14. Each monitored sector 12*a*, 12*b*, 12*c* is shown as including a collection or cluster of monitoring devices, each of which monitors some condition within the respective sector. The monitoring devices depicted in FIG. 1 include smoke monitors 16 (of which there are 2 shown in sector 12*c*); radio linked alert monitors 18; and various activity monitors such as a door movement monitor 20 and a toilet flushing monitor 21. The present invention is not to be limited by the type or number of monitoring devices described in this disclosure. Each monitoring device within a respective, monitored sector 12*a*, 12*b*, 12*c* is connected to a 2-wire bus 23 which is in hard-wired communication between the cluster of monitoring devices 13*a*, 13*b*, 13*c* and the communication center 14. It is seen that there is a separate 2-wire bus 23*a*, 23*b*, 23*c* associated with each monitored sector 12*a*–12*c*. Also associated with each monitored sector 12*a*–12*c* is a resistor 25*a*, 25*b*, 25*c*, also referred to as the signal reflecting resistor, located within the communication center 14. It is also seen that each monitoring device (16, 18, 20, 21) within a single monitored sector 12*a*–12*c* is connected to the respective bus 23*a*–23*c* in parallel electrical connection with the other monitoring devices within the same sector. Furthermore, associated with each cluster 13*a*, 13*b*, 13*c* of monitoring devices is a signal identifier 27*a*, 27*b*, 27*c*, which identifier is, in the preferred embodiments, located within the communication center 14 and placed in parallel, electrical connection with the respective resistor 25a–25c. In the embodiment of FIG. 1, each signal identifier 27a–27c provides human observable output such as, for example, a meter reading or audible alarm (as represented by the meter 28a–28c). In alternate embodiments, the signal identifiers 27a–27c are scanned by a signal scanning and switching device 29 (also referred to herein as a switching interface 29), as depicted in FIG. 2. A central power source 30 is seen in the communication center 14. This central power source 30 provides the operating power for all monitoring devices 16, 18, 20, 21 in all monitored sectors 12a, 12b, 12c. The power is supplied to each sector 12a–12c along the respective two-wire bus 23a–23c**. These are described in more detail below.

Figure 3:
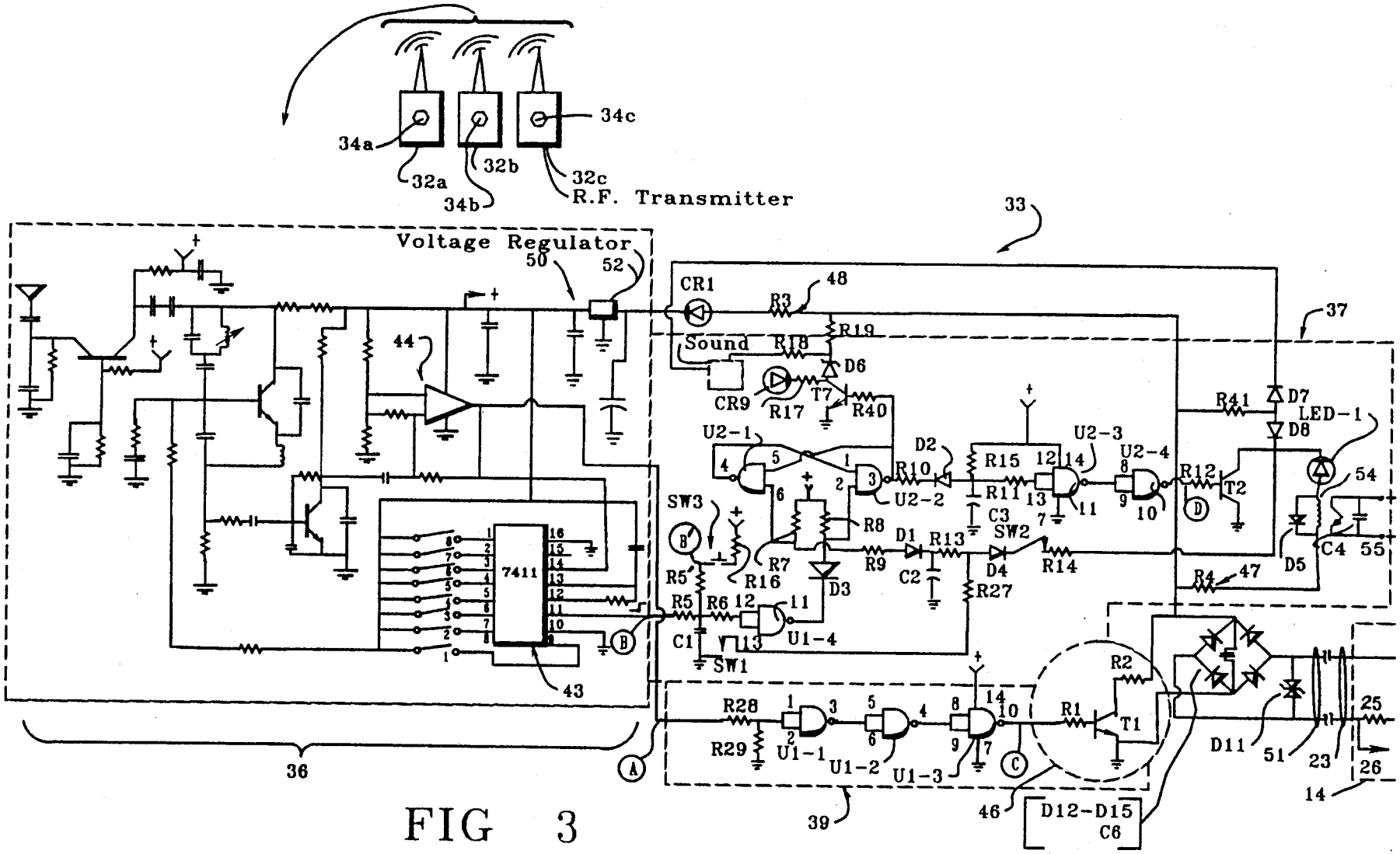
FIG. 3 is an electrical Schematic of a latch/delay module and an encoder module for a radio-linked alert monitor for the system of FIG. 1.
Figure 5A:
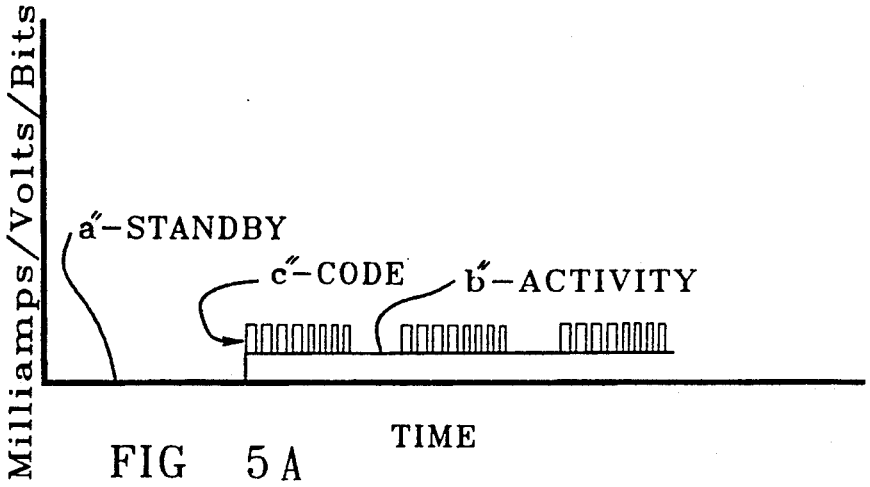
FIG. 5A is a graphic representation of signals generated by the activity monitor of FIG. 5.
Figure 4A:
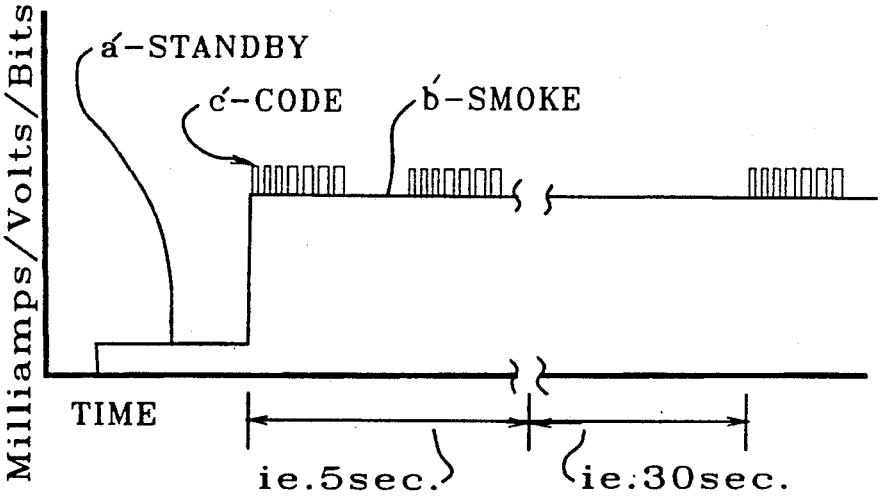
FIG. 4A is a graphic representation of signals generated by the smoke monitor of FIG. 4.
Figure 4:
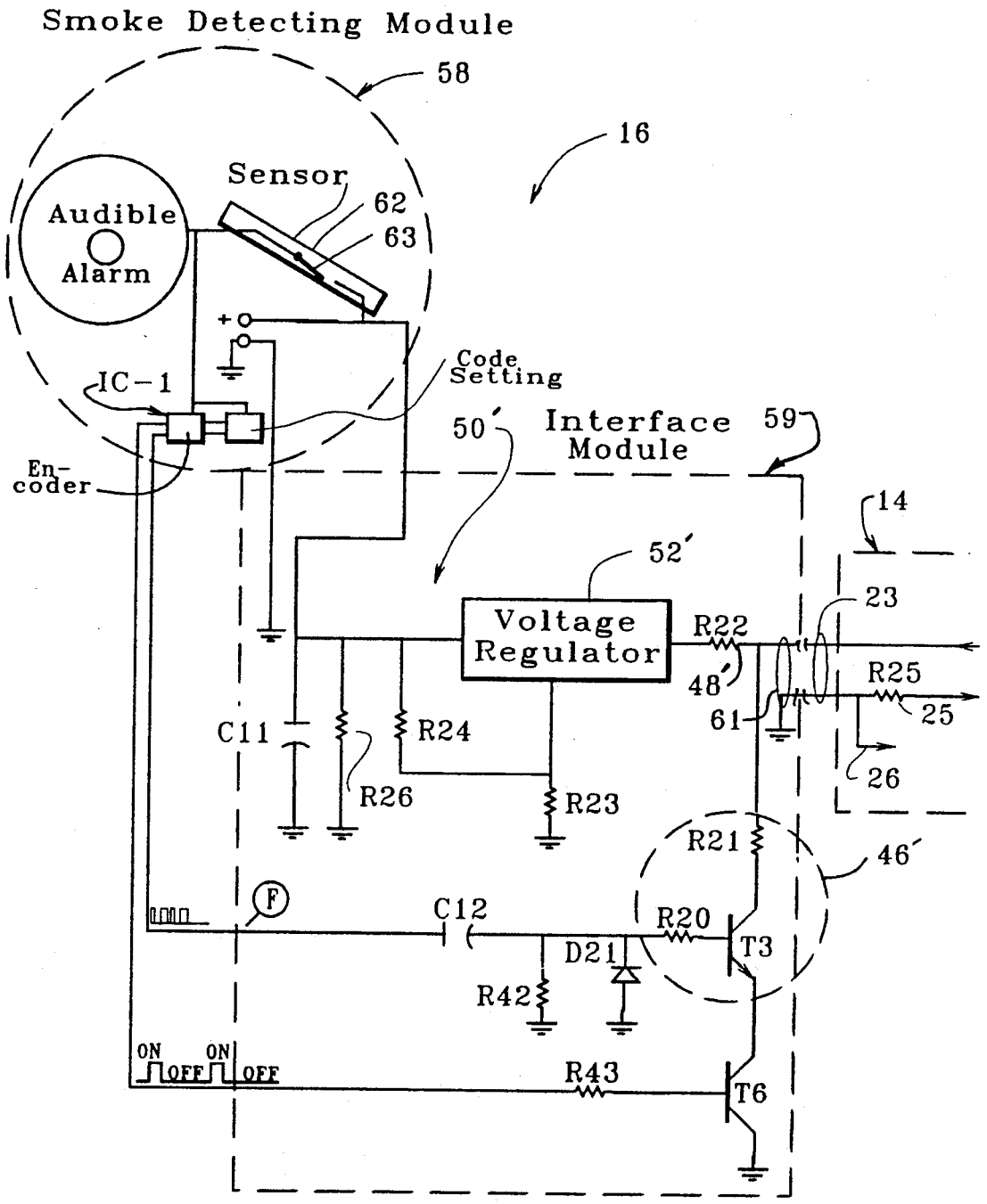
FIG. 4 is an electrical schematic of a smoke monitor for the system of FIG. 1.
Figure 5:
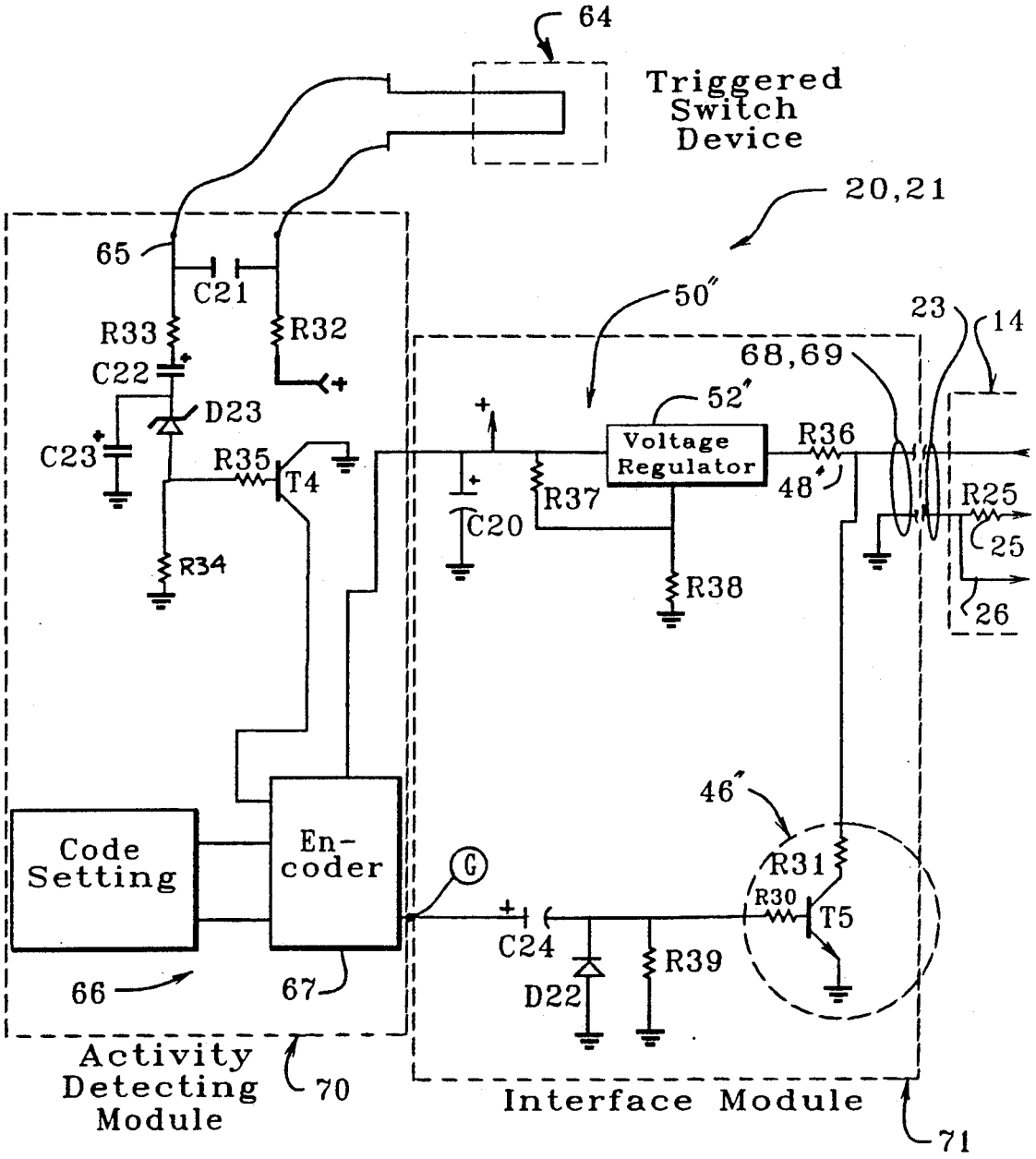
FIG. 5 is an electrical schematic of an activity monitor for the system of FIG. 1.

FIGS. 3, 4, and 5 provide greater detail of the components and operations for the radio-linked alert monitors 18, smoke monitors 16 and activity monitors 20, 21, respectively.

With reference to FIG. 3, a radio-linked alert monitor 18 includes one or more radio transmitters 32, preferrably of the hand held variety. The radio transmitters 32 are of a type typically known in the industry which transmit a selectively coded signal, for example an 8-bit or 16-bit pulse width modulated coded signal. Each transmitter 32 includes an activation trigger 34, such as a button, which is engaged to activate transmission of the radio signal. The construction and function of such transmitters is considered well-known in the industry and does not require additional explanation herein. The embodiment of FIG. 3C is shown as including three (3) radio transmitters 32a–32c. This is by way of example only and is used to correspond with the three-sector example of FIGS. 1 and 2. That is, each of the radio transmitters 32a–32c is a hand held transmitter associated with one of the monitored sectors 12a–12c, respectively, but which may be carried into each of the other sectors. Therefore, in the three-sector example of FIGS. 1 and 2, all three of the radio transmitters 32, could be found, at the same time, in one of the monitored sectors (for example, sector 12a). The electrical schematic detailed in FIG. 3, is that of a radio receiver portion 33 of the radio-linked alert monitors 18. The radio receiver 33 is substantially similar for each and every one of the radio-linked alert monitors 18a–18c. Therefore, the electrical schematic of only one (1) such radio receiver 33 is provided in FIG. 3.

Referring to the electrical schematic of the radio receiver 33 as shown in FIG. 3, the receiver is seen as comprising a series of "sub-modules" which are the radio frequency module 36, latch/delay module 37 and encoder module 39. The receiver 33 is also seen as including a voltage regulating device 50 in the form of a regulating circuit or dedicated voltage regulator 50. The radio frequency module 36 is, for example, a type of radio frequency receiver known in the industry capable of receiving the radio transmission from the transmitters 32. One example of a radio frequency receiver used as the radio frequency module 36 of the preferred embodiment of the present invention is that radio frequency module 36 portion seen in FIG. 3 and is listed on the attached list of example components. The radio frequency module 36 is shown as including a match-code decoder chip 43 and an all-code op-amp 44. Output from the match code decoder chip 43 is, in accordance with the preferred embodiment of the present invention, directed at point "B" to the latch/delay module 37. Output from the code op-amp 44 is, in accordance with the preferred embodiment of the present invention, conveyed at point "A" to the encoder module 39. The encoder module 39 includes a current modulating combination 46 including resistor R1, transistor T1 and resistor R2. An isolation resistor 47 (R4) is seen in the power input line to the latch/delay module 37. Another isolation resistor 48 (R3) is seen in the power input line to the voltage regulating device 50. The entire radio receiver 33 is seen as being built about the 2-line, parallel branch 51 of the 2-line bus 23. It is noted that current modulating combination 46 and latch/delay module 37 (with isolation resistor 47) and voltage regulating device 50 (with isolation resistor 48) are built off the 2-line branch 51 in parallel relationship to one another. It is noted that, in accordance with the present invention, the current modulating combination 46 is placed along the 2-line branch 51 of the 2-wire bus 23 in parallel with and in front of (to the positive side of) all isolation resistors 47, 48; and the isolation resistors are placed in front of and in series with the respective low impedance load (i.e. relay 54, voltage regulating device 50).

The voltage regulating device 50 functions to (1) convert the line voltage supplied from the central power source 30 to an appropriate voltage for operating the receiver 33 of the radio-linked alert monitor 18, and (2) to maintain a constant operating voltage for the receiver regardless of the changing voltages on the bus resulting from changing and modulating current flows (discussed below) within the bus 23. The voltage regulating device 50, therefore, includes an appropriate regulator and associated biasing and filtering functions provided in a manner known in the art.

Figure 3A:
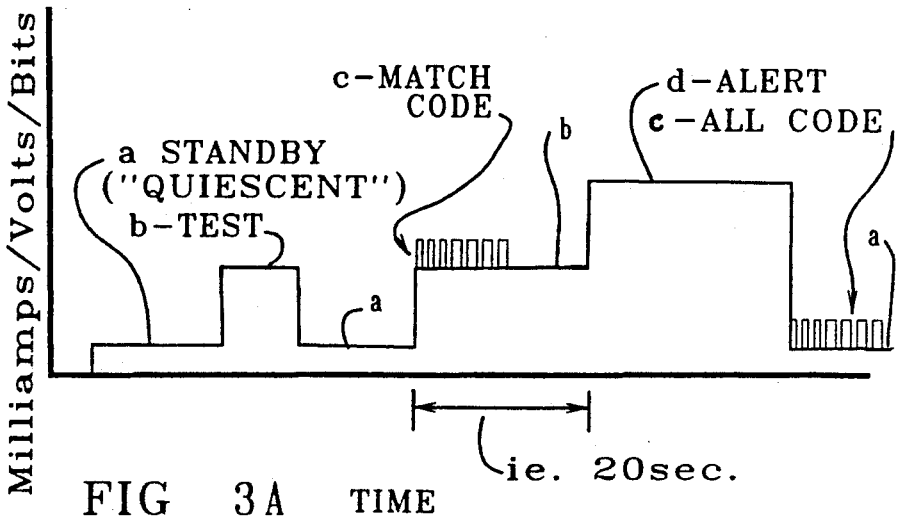
FIG. 3A is a graphic representation of signals generated by the monitor of FIG. 3.

Operation of the receiver 33 of the radio-linked alert monitor 18 is generally explained as follows; specific details of components and operation are given subsequently. The radio receiver 33 receives at its radio frequency module 36 a radio signal transmission from one of the plurality of radio transmitters 32. If the radio signal is from the "home" transmitter (i.e. 32a) associated with the monitored sector (i.e. 12a) in which the specific radio receiver (i.e. 33a) is situated, the radio signal is received and decoded by the match code decoding chip 43 as well as received and output by the code op-amp 44. Output from the receiver module 36 is fed to the latch/delay module 37 and encoder module 39. The modules 37, 39 alternately (or simultaneously), as explained below, effect a change in the current in the power supply loop of the 2-wire bus 23, which current change is reflected as a voltage change across the signal reflecting resistor 25 at the communication center 14. The current change reflected as a voltage change across the signal reflecting resistor 25 is identified by the signal identifier 27 and conveyed as usable output as discussed in more detail below. The current change reflected as a voltage change across the signal reflecting resistor 25 will vary depending upon which elements within the receiver 33 have been activated. For example, with reference to FIG. 3A, simply connecting the receiver 33 to the bus branch 51 places a first level of impedance on the bus 23 which affects a current reflected as a voltage across reflecting resistor 25 (signal a); activation of the modulating transistor T1 by the encoder module 39 places a second impedance value (modulated) on the bus 23 (signal c); latching the receiver in the test mode places a third impedance on the bus 23 (signal b); and activation of the switch transistor T2 by the latch/delay module 37 places still a fourth impedence value on the bus 23 (signal d).

In addition to the basic functions of generating a change in impedance at the receiver 33, which impedance change is reflected and identified at the communication center 14, the radio receiver 33 performs the additional function of generating on the 2-line bus 23 a modulated current flow which modulated current represents the code of the coded radio signal received from the transmitter 32. In this way, a modulated/coded signal is passed down the 2-wire bus 23 which bus also serves as the power supply line from power source 30. This modulated signal is reflected across the signal reflecting resistor 25 and identified at the signal identifier 27. Key elements of the receiver 33 associated with the modulated/coded signal generation are the current modulating combination 46 and the isolation resistors 47 and 48. These elements are key since: (1) it is the current modulating combination 46 which actually modulates the current in the bus 23 in a modulated sequence of pulses corresponding to the code received at the all-code op-amp 44, as discussed in greater detail below; and (2) the isolation resistor 48 isolates the low impedance filtering of the voltage regulating device 50 from the current modulating combination 46; and (3) the isolation resistor 47 isolates the low impedance of the relay 54 from the current modulating combination 46. The low impedance of the filtering and the relay would otherwise tend to short out the pulse generated by the modulating combination.

More detailed description of components and operation of the radio receiver 33 is now provided. When the trigger 34 of any transmitter 32*a*–32*c* is engaged, that transmitter transmits a coded radio signal. The radio signal from any transmitter 32*a*–32*c* within range of one of the receivers (i.e. 32*a*) will be received by that receiver 33*a*. Any coded signals, that is, from any of the transmitters 32*a*–32*c*, will be processed through the all-code op-amp 44. When the all-code op-amp 44 receives the code from a radio transmitter 32*a*–*c*, the code is actually inverted from the code desired for communication into the current modulating combination 46. In addition, noise exists. Therefore, a series of code shaping circuits U1-1, U1-2, U1-3 are arranged in a combination typically known in the industry as a Schmidt trigger logic gate which both inverts the code signal and "cleans" some of the noise off of the code. The output signal from the code shaper is communicated to the current modulating combination 46 at point "C" through resistor R1 and the base of transistor T1; and this shaped output provides more than adequate current to drive the modulating transistor T1 (also known as the "code encoder transistor") directly. The current modulating combination 46 operates as follows: the shaped, inverted and cleaned-up coded signal output from the code shaping logic circuits is fed into the base of the transistor T1; the alternating high-low level of the code (or pulses) which enter the base of transistor T1 alternately turns the transistor on and off causing, alternately, more or less current to be "pulled" through resistor R2 (also known as the "encode resistor") and from the 2-wire branch 51 of the 2-wire bus 23, thus modulating the current in the bus in correspondence with the coded signal; and, in turn, the same modulated current is reflected as a voltage across the signal reflecting resistor 25 at the communication center 14. By way of example, if the receiver 33 is receiver 33*a* of monitor sector 12*a*, the modulated current will be generated along the respective 2-wire bus 23*a* and reflected as a voltage across the related signal reflecting resistor 25*a*.

When the user, who actually possessess the radio transmitter 32 ("home transmitter") which is matched by code to the respective radio receiver 33, activates the transmitter, the matching code signal is picked up by the match code decoder chip 43. By way of example only, such a situation is where monitored sectors 12*a*, 12*b* and 12*c* are each apartment areas within a nursing home; and the resident of monitored apartment 12*a* carries with him/her the radio ("home") transmitter 32*a* which matches the specific code expected by match code decoder chip 43 of the radio receiver 33*a*. Thus when the resident of apartment 12*a* is within transmission distance of his/her apartment when the radio transmitter 32*a* is activated, the coded signal will be received at both the all-code op-amp 44 and the match code decoder chip 43 (the all-code circuit has been explained above). There is a DC level shift that occurs at point "B" whenever the specific code is received at the radio receiver 33 (i.e. 33*a*) from the matching transmitter 32 (i.e. home transmitter 32*a* worn by the resident of apartment 12*a*). That is, upon receiving a coded signal, the match code decoder chip 43 samples and verifies the code to determine that it is the matching code and then creates a high DC level, as indicated, at point "B" as input to the latch/delay module 37. A second manner of creating a high DC level as input to the latch/delay module 37 is to depress the hard-wired "panic" button SW3. This creates a high DC level at point "B'", thus bypassing the transmitter 32 function. The combination latch/delay module 37 is seen in FIG. 3 directly above the encoded module 39. This latch/delay module 37 functions, first, to allow the user to periodically test the radio-linked alert monitors 18 without setting off an actual alarm at the communication center 14 and without alerting an attendant; and second to provide verification of an emergency condition if the user is not simply testing the monitor.

From point "B" (or B') the DC signal passes through a small RC delay including resistor R5 and capacitor C1 (or R5' and C1); and then enters an inverter combination of resistor R6 and logic inverter U1-4. The RC delay slows down propagation of the signal through the circuit so that the resident must engage the transmitter activation trigger 34 for a certain period of time to overcome the delay. This keeps to a minimum the number of "false alarms" by simple accidents of brushing the trigger or pushing the trigger very quickly. In the disclosed example of the present disclosure, R5 is 2.2 meg ohms and C1 is 0.1 microfarads which requires activation of the trigger 34 for at least 200 milliseconds. The output from logic inverter U1-4 is input to a flip-flop or latch created by using two sections U2-1 and U2-2 of four-section logic circuit U2. The latch is as shown in the drawing. Pins 2 and 6 are held high by two resistors R7, R8 in a circuit with the voltage regulator 50. Pin 2 is the "set" command and Pin 6 is the "reset" command. When power is first supplied, the flip-flop automatically goes to a condition where pin 3 is low (logic 0) and pin 4 is high (logic 1). Since pin 3 is tied to Pin 5, then if pin 3 is held down for a short period of time when power is coming up, then pin 5 will also be held low, forcing pin 4 high. In such combination the system will keep pin 3 low. Pin 3 is kept low and pin 4 is kept high when the power is first supplied by virtue of the fact that the capacitor C2 is initially discharged which, through resistor R9 and diode D1, keeps pin 6 low and establishes the initial condition of the flip-flop until such time as capacitor C2 is charged. When power is first supplied and pin 3 is low, then through R10 and D2, capacitor C3 is held low. The low at pin 3 is converted to a high at pin 11 of logic circuit U2-3 through the action of logic circuit U2-3 and resistor R11. The signal is again converted to a low at pin 10 of logic circuit U2-4. Thus, the signal is low at point "D" which is the entrance to resistor R12 and to the base of switching transistor T2; and, thus, there is no driving current for transistor T2. Therefore, in the initial condition, there is no drive to the switch transistor T2; and, in this condition, the relay 54 is open and the LED-1 does not light.

Once a signal from the radio transmitter 32 (i.e. 32*a*), carrying the match code, is received at the match code decoder chip 43 of the radio receiver 33 (i.e., 33*a*) the high level signal is generated at point "B". After the initial, short delay, created by R5 and C1 expressed above, the signal is inverted at inverter U1-4 producing a low at output pin 11 of U1-4. This low "flips" the flip-flop so that pin 3 of U2-2 becomes high; capacitor C3 begins to charge. There is a built-in delay (i.e. in the disclosed example a 20 second delay) during which the capacitor C3 is charging. During that period of delay, the individual who has activated the transmitter 32*a* has the opportunity to push the reset button SW1. This will be the case if the user was performing a periodic test. That is, the transmitter 32*a* is activated; match code is identified at decoder chip 43; latch/time delay module 37 begins its sequence; and within the delay (i.e. 20 seconds) the reset button SW1 is pressed to prevent continuation of the sequence. Thus, no alert signal is sent to the communication center.

In one embodiment of the present invention, a loud sound alarm is sounded during the test period and a visible alarm is seen. The sound and visible alarm are local to the receiver 33 as a verification to the user that the receiver 33 is operating and has begun its signalling operation. The sound alarm is shut off when the reset switch SW1 is pushed. It is noted that even during the test period, a signal has been sent to the communication center 14, which signal is in the form of a change in the current level experienced on bus 23*a* developing a voltage across signal reflecting resistor 25*a* as a result of the sound and visible alarm turning on. The change in current level generated on bus 23*a* during the test period is different (i.e. less) than a change in current level during an actual alert (i.e. after the test period delay of, for example, 20 seconds). (Refer to FIG. 2A.) Thus, the signal reflected across resistor 25*a* is identified at the signal identifier 27*a* as a test signal and not an alert signal. In embodiments where a central computer is located at the communication center 14, the computer knows, from the output of an associated level sensing analog-to-digital ("A/D") converter, that the system was tested and the computer logs the test without indicating an alert condition to the attendent. Such a process allows the care-giver (i.e. facility) to request periodic testing of the system by the user and, occasionally, to automatically call up from the computer memory bank to the owners of the various systems (residence of apartments 12*a*, 12*b* and 12*c*) who have not tested their systems for a specific period of time.

If the reset switch SW1 is not pushed during the test delay period, as may be the case in an actual emergency, the capacitor C3 continues to charge until U2-3 is turned on (for example, after the twenty second delay). At this time pin 11 of U2-3 goes low forcing pin 10 of U2-4 to go high. The high level at point "D" turns on the switching transistor T2 which draws current through LED-1 and the relay 54 from the 2-line branch 51 and thus from the 2-line bus 23.

In one embodiment of the present invention, such as a "retrofit" embodiment, the relay 54 is connected to the existing wiring within the monitored sector (i.e. apartment 12*a*) of an existing, hard-wired nurse call system. Thus, the activated relay would in turn activate the nurse call alarm. In alternate embodiments, the relay 54 is attached to another selected, switch activated device such as, but not limited to, louder sounding devices, strobe lights, paging systems to call other individuals, or autodialing systems. In still other, alternate embodiments, the relay 54 is not connected across its output 55 to any other device.

Whether or not the relay output 55 is connected across an additional device (such as a nurse call system), once the relay 54 is closed, current flows from the 2-line branch 51 of bus 23 through the resistor 47 (R4), through the relay coil 54 and transistor T2 to ground, thus placing an added impedance on the bus 23. This added impedance creates an increase in the current flow through the bus 23 which increase is reflected as an increase in voltage across signal reflecting resistor 25. Thus, the signal identifier 27 identifies this current change and recognizes it as an "alert" signal. In the preferred embodiment, the radio receiver 33 is so designed that closure of the relay 54 will result in a known impedance being placed on the 2-wire bus 25. That is, not just an impedance, but a known impedance having a known, identifiable effect on the bus current and, thus, on the voltage level reflected across the signal reflecting resistor 25. Thus, an observer at the communication center 14 or a computer or other device at the communication center can immediately identify that the radio receiver relay has been closed, that an "alert", not just a test, is in progress, that this is an alert situation in a known monitored sector (i.e. 12*a*.) associated with the respective 2-wire bus (i.e. 23*a*), and that the apparent emergency is experienced by the resident carrying the match code radio transmitter (i.e. 32*a*).

Attention is directed to the switch SW-2 of FIG. 3. Review of the associated circuitry will show that SW2 is a switch determining the duration of activation of the relay 54. If the switch SW2 is closed, the flip-flop will be "reset" after a defined period of time (i.e. approximately 5 seconds as determined by C2, R13 and R14 in the disclosed example). Once the flip-flop is reset, the transistor T2 is turned-off and the relay 54 is opened. If the switch SW2 is open, the relay 54 will remain closed until an attendant, for example, pushes reset button SW1. Such feature has application, for example, when retrofitting to nurse call systems of different design. Some nurse call systems operate on a momentary closure of a switch such as relay 54; and other nurse call systems operate by virtue of a switch such as relay 54 remaining closed.

Thus, it can be seen that a radio-linked alert monitor 18 is provided which includes a radio receiver 33 which accepts radio transmitted signals from a plurality of radio transmitters 32, including the "home" transmitter which transmits a signal with a code matched to the receiver and also including "visiting" or passing transmitters which transmit a variety of unmatched radio signals. Furthermore, the receiver generates a variety of identifiable signals on a 2-wire bus 23 which is the same 2-wire bus supplying operating power to the radio receiver. The variety of identifiable signals identify and discriminate among: status of a transmitter 32 within the plurality of transmitters (i.e. triggered or untriggered status); testing of the monitor 18 operation; call for assistance by the holder of a transmitter; and identification of the transmitter signaling for assistance. See FIG. 3A (and FIG. 7) for an example of the varied and identifiable signals associated with these and other conditions monitored and identified by the system of the present invention.

Referring now to FIG. 4, a representative example of a smoke monitor 16 outfitted and operating in accordance with the present invention, is seen in some detail. The smoke monitor 16 includes two (2) major portions: The smoke detecting module 58 and the interface module 59. The smoke detecting module 58 is of a type constructed and operating in a manner known in the smoke alarm industry and, therefore, detailed description of its inner circuitry and operations is considered unnecessary for purposes of this disclosure; except that description will be given to the degree necessary for clarity and understanding of the smoke detecting module's integration as a part of the present invention. Generally, when smoke is detected at a sensor 62, a switch 63 is closed and provides power to an encoding chip IC-1. With reference to the interface module 59, a current modulating combination 46' including resistor R20, encoder transistor T3 and encoder resistor R21, is used to modulate current flow within 2-line branch 61 of the 2-wire bus 23. This current modulating combination 46' includes elements similar to and functions similar to that current modulating combination 46 of the radio-linked alert monitor 18 of FIG. 2. The modulation is controlled by a series of pulses emanating from the encoding chip IC-1 in the smoke detecting module 58. That pulsing code is fed to the transistor T3 and turns the transistor on and off in responses to and corresponding with the pulsing sequence of the code. As the transistor T3 is turned on off, current flows through resistor 21 through the collector and emitter of transistor T3 in a modulated current flow which modulation is effected by and corresponds to the pulsing code which drives transistor T3. This modulated current flow effects a corresponding modulated current flow in the 2-line branch 61 and, thus, in 2-wire bus 23. With further reference to the interface module 59, an isolation resistor 48' and a voltage regulating device 50' are seen in parallel relationship with the current modulating combination 46'. As expressed with respect to FIG. 2, the isolation resistor 48' keeps the low impedance circuitry of, for example, the voltage regulating device 50' from interfering with the higher frequency pulses of the modulated (coded) current which is being fed along the 2-wire bus to the communication center 14.

The voltage regulating device 50' functions (1) to convert the line voltage supplied from the central power source 30 to an appropriate voltage for operating the smoke monitor 16, and (2) to maintain a constant operating voltage for the monitor regardless of the changing voltages on the bus resulting from changing and modulating current flows within the bus 23. By way of example, the central power source 30 provides 24 volts, but voltage on the bus can drop to, for example, 19 volts due to the effect of various monitors on the bus acting in accordance with the present invention. The regulating device 50' is to maintain an approximately constant voltage of, for example, 9 volts for operation of the smoke detector module 58. The voltage regulating device 50', therefore, includes an appropriate voltage regulator 52' and associated biasing and filtering functions provided by resistors R23, R24 and R26 and capacitor C11.

Thus, it can be seen that a normal quiescent current level is generated along 2-wire branch 61 and, thus, bus 23 when a smoke detector 16 is "on-line" and operating power is supplied along the 2-wire bus 23 to the smoke monitor. In the event of a smoke or fire condition, the smoke detecting module 58 detects smoke at its sensor 62 to thus close the sensor activated switch 63 within the smoke detecting module. This switch 63 closes alarm circuitry within the smoke detecting module 58 to sound an audible alarm and decrease the impedance level of the smoke monitor which is on line with the 2-line branch 61, thus increasing the current within the bus 23. The current increase is reflected as a voltage across signal reflecting resistor 25 and is identified at the signal identifier 27. In those embodiments of the present invention in which the smoke detecting module 58 generates a coded signal as discussed above, that coded signal creates a pulsing drive signal at transistor T3 resulting in a modulated (and thus coded) current flow within the bus 23 as also discussed above. That modulated current flow is also reflected across signal reflecting resistor 25 as a train of voltage pulses riding on top of the DC drop. In the disclosed embodiment of FIG. 4, the modulated current flow is provided in an intermittent manner by action of the transistor T6 driven intermittently on and off by the encoding chip IC-1. In the disclosed example, the modulated flow is cyclically 5 seconds on and 30 seconds off.

Thus, it can be seen that the smoke monitor 16 of the present invention generates a variety of identifiable current signals (by way of example, those signals a', b', c' of FIG. 4A) through which an observer or computer at the communication center 14 can assess various statuses of the smoke monitor such as; the monitor being on line (signal a'); and a detected smoke condition (signals b' and c' of FIG. **4*a*). The location of the smoke monitor 16 is determined by the attendant or computer or other device at the communication center 14 by association with the respective 2-line bus 23*a*–23*c*. In embodiments where two or more of a similar monitor, such as two or more smoke monitors 16, are connected to the same 2-wire bus, the monitors are distinguishable by their unique codes identified by the modulated current signal (c' of FIG. 4A) reflected across signal reflecting resistor 25. An example of such multiple smoke monitors is seen in monitored sector 12*c* of FIG. 1**.

Referring now to FIG. 5, a representative schematic of one of the automatic activity monitors, such as the door movement monitor 20 or the toilet flushing monitor 21, is shown. It is to be understood that many other types of activity monitors are contemplated as being used in the alternative or in combination with the mentioned door and toilet monitors. Furthermore, the schematic of FIG. 5 represents only one example of an acceptable schematic in accordance with the present invention. Even though this disclosed embodiment mentions the activities monitored as being a flushing of a toilet and the opening of a door, such as a bedroom door or apartment door, it is within the scope of the present invention to associate an activity monitor with any number of other activities such as opening a refrigerator door, or wetting of a bed. In this way, activity monitors can be used to alert a care-giver to a variety of assistance needs. For example, failure of a resident to open a door over a long period of time can indicate the need to check on the resident's wellbeing; failure of a resident to operate the toilet flush handle over a period of time can indicate the need for a special type of medical attention, even though the resident is moving about and opening doors; detecting of moisture in a bed or in a diaper can alert a caregiver to the need for quick attention to the resident.

Each activity monitor 20, 21 includes two (2) major portions: the activity detecting module 70 and the interface module 71. The activity detecting module 70 includes a triggered switch device 64. Examples of triggered switch devices are: a mercury switch attached to the flush lever on a toilet; a toggle-type switch connected between a door and door stop; a moisture sensitive switch placed within the bedding on a bed; a photoelectric switch mounted in a doorway. Whenever the switch device 64 is triggered to, for example, close the appropriate switch, power flows along path 65 to activate transistor T4. Activation of transistor T4 completes the ground path to the encoding circuitry 66 associated with the activity monitor 20, 21. In a construction similar to that of the radio receiver 33 (FIG. 2) and the smoke monitor interface module 59 (FIG. 3), each activity monitor 20, 21 is wired in parallel through its respective 2-line branch 68, 69 to the common 2-wire bus 23 (i.e. 23*a*). The encoding circuitry 66 includes a code or pulse generating chip 67. In the disclosed example, and for example purposes only, the coded pulses of the activity monitor are created by applying power to a small radio transmitter in a manner similar to that of the radio transmitter 32 of the radio linked alert monitor 18. Such transmitter circuitry is considered known in the industry and requires no further explanation here. For purposes of the disclosed embodiment, the pulsing, coded output from the encoding chip 67 is hard-wired at point "G" to the interface module 71 instead of being transmitted as a radio signal.

With reference to the interface module 71, a current modulating combination 46", including resistor R30, encoder transistor T5 and encoder resistor 31, is used to modulate current flow within the 2-line branch 68 (or 69, respectively) of the 2-wire bus 23 (i.e. 23*a*). This current modulating combination 46" is noted as including elements similar to and as functioning similar to that current modulating combination 46 of the radio-linked alert monitor 18 of FIG. 2 and that current modulating combination 46' of the smoke monitor 16 of FIG. 3. The modulation is controlled by the pulses emanating from the pulse generating chip 67 entering the base of transistor T5 through resistor R30. The coded pulsing signal from chip 67 turns the transistor T5 on and off in response to and corresponding with the pulsing sequence of the code. As the transistor T5 is turned on and off, current flows through resistor 31 and then through the collector and the emitter of transistor T5 in a modulated current flow which modulation is effected by and corresponds to the pulsing code which drives transistor T5. This modulating current flow effects a corresponding modulated current flow in the 2-line branch 68 (69, respectively) and, thus, in the 2-wire bus 23 (i.e. 23*a*). With further reference to the interface module 71, an isolation element 48" and a voltage regulating device 50" are seen in parallel relationship with the current modulating combination 46". As expressed with respect to FIGS. 2 and 3, the isolation resistor 48" keeps the low impedance circuitry of, for example, the voltage regulating device 50" from interfering with the higher frequency pulses of the modulated (coded) current which is being fed along the 2-wire bus to the communication center 14.

The voltage regulating device 50" functions (as in the monitors 18, 16 of FIGS. 2 and 3) to convert the fluctuating DC voltage, caused by the changing current within the 2-wire bus 23, to an appropriate voltage for operating the activity monitor 20, 21. By way of example, the central power source 30 provides 24 volts which is converted to, for example, 9 volts for operations of the activity detecting module 70. The voltage regulating device 50", therefore, includes an appropriate voltage regulator 52" and associated biasing and filtering functions provided by resistors R37 and R38 and capacitor 20.

Thus, as with the smoke monitor 16 and radio-linked alert monitors 18, it is seen that a normal quiescent current level is generated along 2-wire branch 68 and, thus, bus 23 when a door movement monitor 20 is "on line" and operating power is supplied along the 2-wire bus to the door movement monitor 20. Similarily, a different, normal, quiescent current level is generated along 2-wire branch 69 and, thus, bus 23 when a toilet flushing monitor 21 is "on line" and operating power is supplied along the 2-wire bus 23 to the toilet flushing monitor 21. A different, normal quiescent current level is generated on the 2-wire bus 23 (i.e. 23*a*) by each of the attached activity monitors, including monitors other than the door and toilet monitors. In the event of a door movement condition, or in the event of a toilet flushing condition (or in the event of a wet bed condition, etc.) the activity detecting module 70 detects the condition at its triggered switch device 64 to activate the switching transistor T4. Activation of the switching transistor T4 places additional circuitry (such as encoding circuitry 66) on-line on the 2-wire bus 23 and decreases the impedance level of the activity monitor 20, 21, thus effecting a current increase within the bus 23 (i.e. 23*a*). The current increase is reflected across signal reflecting resistor 25 (i.e., 25*a*) as a voltage increase and is identified at the signal identifier 27 (i.e. 27*a*). In those embodiments of the present invention in which the activity detecting module 70 generates a coded signal as discussed above, that coded signal generates a coded drive signal at transistor T5 resulting in a modulated (and thus coded) current flow within the bus 23 (i.e. 23*a*) as also discussed above. That modulated current flow is also reflected across signal reflecting resistor 25.

Thus, it can be seen that each activity monitor 20, 21 of the present invention generates a variety of identifiable current signals (by way of example, those signals a", b", c" of FIG. 5A) through which an attendent or computer at the communication center 14 can assess various statuses of the activity monitor such as: the monitor being on-line (signal a"); and the detected activity conditions (signals b" and c" of FIG. 4A). The standby signal a" is seen, in the disclosed example, as being negligibly small. The location of the activity monitor 20, 21, such as in which monitored sector 12, is determined by the attendant or computer at the communication center by association with the respective 2-line bus 23*a*–23*c*. The identity of the specific activity monitor is determined by one of two methods, which methods may be performed in the alternative or performed simultaneously as verifications one of the other. In a first method, each activity monitor is constructed to generate a different impedence level when the activity is detected (i.e., signal b" of FIG. 5A); whereby the attendant or computer in the communication center 14 identifies the monitor by discerning the changed current flow reflected across the signal reflecting resistor 25. In the second method, each activity monitor 20, 21 is coded with a unique code generated at the pulse generating chip 67. That is, the code of each door monitor is different from each other door monitor and also different from each toilet flushing monitor and each moisture monitor, etc. Thus, each activity monitor is distinguishable by its unique code identified by the modulated current signal reflected as a train of voltage pulses across signal reflecting resistor 25; see signal c" of FIG. 5A).

Furthermore, in preferred embodiments of the present invention, the quiescent, impedance level of each monitor (16, 28, 20, 21), including smoke monitors, activity monitors and radio-linked alert monitors is different from that of each and every other monitor within the same sector 12*a*–12*c*. Also, in alternate embodiments, the code affecting the current modulating means 46, 46', 46" of each monitor (16, 18, 20, 21) is different from the code of each other monitor within the same sector 12*a*–12*c*, and, in some embodiments, within all monitored sectors.

Figure 3B:
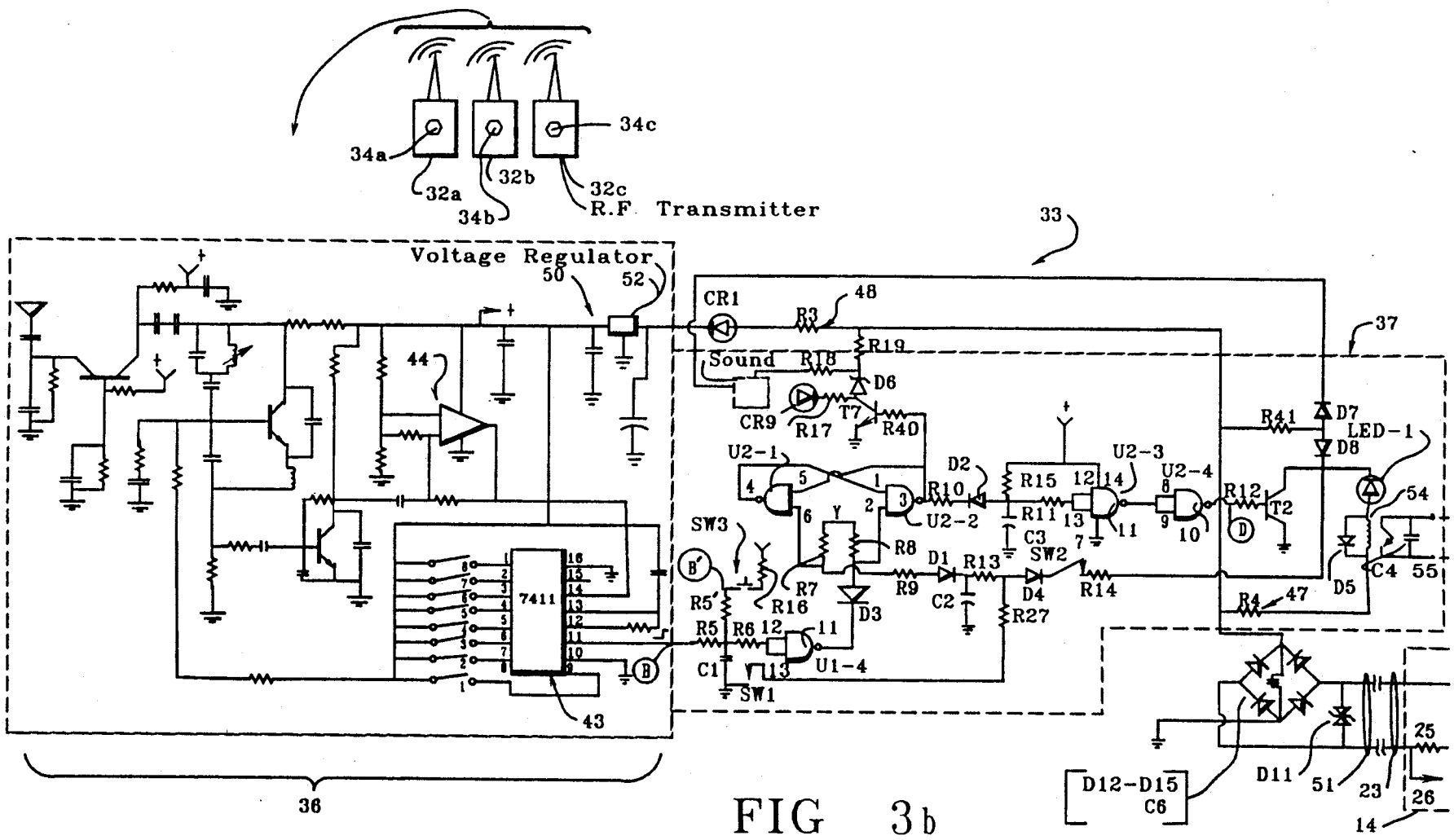
FIG. 3B is an electrical schematic of an alternate embodiment of the radio-linked alert monitor of FIG. 3.
Figure 4B:
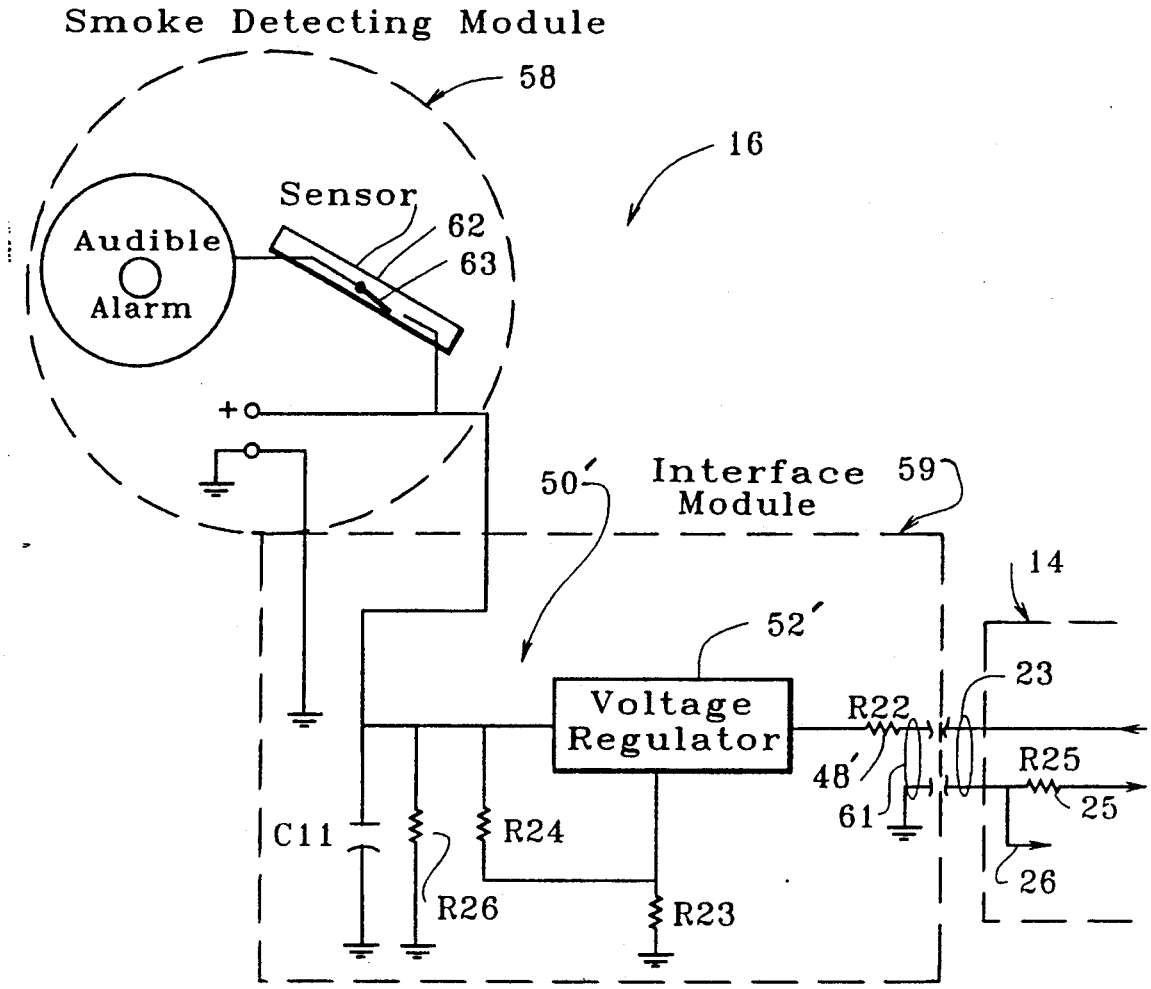
FIG. 4B is an electrical schematic of an alternate embodiment of the smoke monitor of FIG. 4.
Figure 5B:
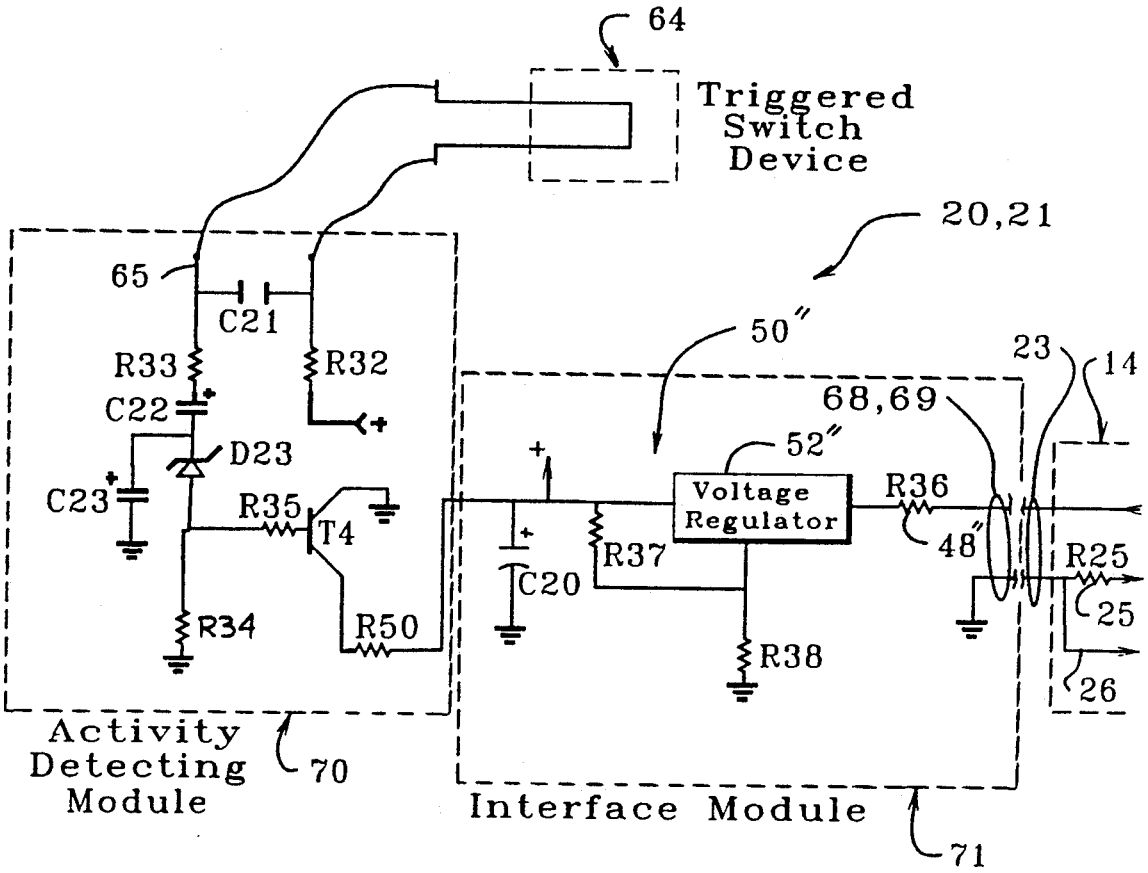
FIG. 5B is an electrical schematic of an alternate embodiment of the activity monitor of FIG. 5.

Having discussed the complete details of the preferred embodiment of the cluster of monitoring devices 13 as seen in FIGS. 3, 4 and 5, attention is now directed to the alternate embodiments of FIGS. 3B, 4B and 5B. In these alternate embodiments, each of the various monitoring devices 16, 18, 20, 21 is seen as being constructed without the current modulating combination 46, 46', 46". It will be understood by reference to the involved discussions above, that the monitoring devices of these embodiments are used to replace one or more of the more complex monitoring devices (FIGS. 3, 4 and 5) within the monitoring system of the present invention. The monitoring devices of these alternate embodiments of FIGS. 3B, 4B and 5B provide the similar condition monitoring, locating and identifying functions expressed above; except that additional features made possible by the coded signals are not available.

Furthermore, alternate embodiments of the present invention provide for the smoke monitor 18 and activity monitors 20, 21 to be radio-link devices. In such embodiments, the encoding circuitry, such as IC-1 of FIG. 4 and circuitry 66 of FIG. 5, generates a pulsing signal which is transmitted as a radio signal to the respective interface modules 59, 71 for input at points "F" and "G", respectively, for driving the respective modulating transistors T3, T5.

With reference to FIGS. 1 and 2, it is seen that in accordance with the preferred embodiment of the present invention, and as expressed above, there is associated with each monitored sector 12*a*–12*c* a signal reflecting resistor 25*a*–25*c* and a signal identifier 27*a*–27*c*. Each combination of signal reflecting resistor and signal identifier (25*a* and 27*a*, 25*b* and 27*b*, 25*c* and 27*c*) functions to discriminate among the various current flow changes and modulations occuring within the respective 2-wire bus 23*a*–23*c* and to provide a usable output from which a person such as an attendent, or a device such as a computer, within the communication center 14 ascertains, for example, the existence of a potential emergency condition, the nature of that potential emergency condition and the approximate location of such condition. A current across a signal reflecting resistor 25*a*–25*c* will result in a voltage drop across that resistor. Since the resistor 25 is of set value, a change in the current across the resistor is reflected by a change in voltage drop across the resistor. Each of the signal identifiers 27*a*–27*c* is connected across its associated signal reflecting resistor 25*a*–25*c* such that the voltage drop across the signal reflecting resistor 25*a*–25*c* is experienced at the signal identifier 27*a*–27*c*. In one embodiment of the present invention, such as depicted in FIG. 1, a signal identifier 27*a*–27*c* takes the form of an analog device which receives the voltage input along its respective input line 26*a*–26*b* and displays that output directly as, for example purposes only, a meter reading, or graph or chart display (as depicted by symbols 28) with associated buzzer. Examples of this signal identifier 27*a*–27*b* acceptable for use in this embodiment are a voltage meter, memory oscilloscope, and/or high speed or memory chart recorder.

Figure 6:
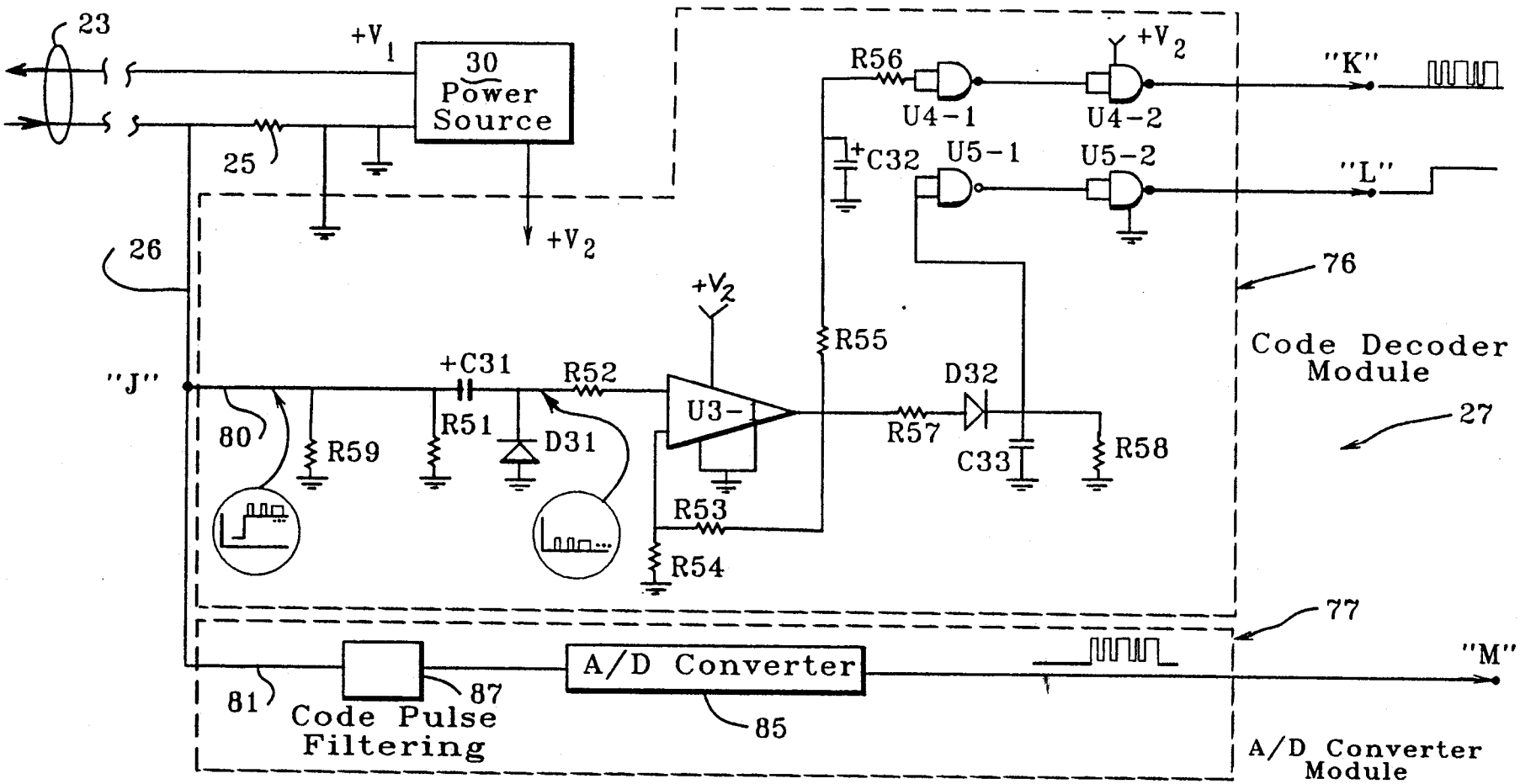
FIG. 6 is a schematic representation of a signal identifier for the monitoring system of the present invention, showing one embodiment thereof.

In an alternate, yet preferred embodiment of the present invention, each of the signal identifiers 27*a*–27*c* is an intermediate device which conditions data for output to a subsequent device, such as a display, alarm, recording, storing and/or processing device (hereinafter collectively or individually referred to as the "guard device" 31). In the drawing of FIG. 1, the numeral designation 28-31 represents either the direct output 28 of the analog device of the previously mentioned embodiment or the subsequent guard device 31 of this second mentioned embodiment. FIG. 6 shows details of a signal identifier 27 used as this intermediate device within the alternate, preferred embodiment. The signal identifier 27 of FIG. 6 is seen as comprising a code decoder module 76 and an analog-to-digital module 77. Each signal identifier 27*a*–27*c* is substantially similar to that of FIG. 6. In the upper left corner of FIG. 6, are seen the common power source 30 and one of the 2-wire, signal/power buses 23 (i.e. 23*a*) and the signal reflecting resistor 25 (i.e. 25*a*) associated with that 2-wire bus. The identification signals, in the form of changed current levels and/or modulated current (see FIGS. 3A, 4A and 5A) effect corresponding changes and modulation in the voltage being developed across the signal reflecting resistor 25. This changing and/or modulating voltage is the same voltage experienced at point "J" of FIG. 6. At point "J", the voltage signal is experienced across two parallel paths 80, 81. Path 80 leads to the code decoder module 76 wherein the voltage signal passes through a capacitor C31. Capacitor C31, diode D31 and resistor R51 function as an AC coupled, positive DC clamp circuit in order to make available for processing the full peak-to-peak amplitude of the incoming code, which code is the modulated voltage developed across the signal reflecting resistor 25. The resulting code is acted upon by a signal amplifying combination including operational amplifier U3-1 and resistors R52, R53 and R54. From the amplifier, the amplified signal is acted upon by two decoding circuits. One decoding circuit includes resistors R55, R56 and capacitor C32 and two code-shaping logic circuits U4-1 and U4-2. The code shaping logic circuits are preferably in the form of two schmidt trigger inverting logic gates. The output of this decoding circuit, at point "K", is a re-creation of the code as originally occuring at the monitored sector 12 (i.e. 12*a*). That output code at point "K" is the code coming from the receiver 33 or the smoke monitor 16, door monitor 20 or toilet flushing monitor 21, for example. The second decoding circuit receiving output from the signal amplifier U3-1 includes resistor R57, diode D32, capacitor C33, Resistor R58 and code shaping logic circuits U5-1 and U5-2. The logic circuits U5-1, U5-2 are also, preferrably, in the form of two schmidt trigger inverting logic gates. This second decoding circuit functions to integrate the amplified, modulating voltage signal into a DC level, and shape the DC level into a "flag" at point "L". The output signals at points "L" and "K" are useful output for delivery to a guard device 31. The output at point "L" is used to tell the guard device 31 that a code has been received and the output at point "K" is used to tell the guard device which particular code has been received. By way of one example only, this output is usable as follows: output from point "K" is directed to a display device such as a storage oscilloscope or memory chart recorder, and output from point "L" is directed to activate an audible alarm alerting an attendant to check the display device. Attendant then deciphers the code at the display device using, for example, prepared overlay graphics.

The voltage signal at point "J" is also experienced along path 81 which provides voltage input to the analog-to-digital module 77. The voltage along Path 81 is seen as being input to an A/D converter, integrated circuit chip 85, of a type known in the industry which functions to take the analog DC voltage signal input through point "J" (with code pulses removed by pulse filtering 87) and deliver a digital output at point "M" which is a digital representation of the voltage signal at point "J". This digital output is usable at a guard device 31.

In still another, alternate embodiment, depicted in FIG. 2, the communication center 14 includes a switching interface 29 which is shared by all signal identifiers 27*a*–27*c*. The switching interface 29 functions to alternately switch data output from each of the signal identifiers 27*a*–27*c* into communication with a common guard device 31.

For purposes of providing an example only, identifying information for circuit components used in the disclosed examples of the drawings are listed in Attachment I attached hereto and made a part hereof by this reference. In the preferred embodiments, when choosing values for the various isolation resistors 47, 48, 48', 48'', encoder resistors R2, R21, R31 and signal reflecting resistors 25*a*–25*c*, consideration must be given to balancing among: (1) proper regulator 50, 50', 50'' (or relay 54) operation; (2) maximum isolation of low impedance from the modulating combination 46, 46' 46''; and (3) minimum identifiable amplitude of the code pulses received at the signal identifier. Preferably, a maximum isolation is accomplished while still obtaining proper regulation and minimum identifiable pulse amplitude during lowest voltage available on the 2-wire bus 23 after the voltage drop across the signal reflecting device. This balancing must be accomplished in each and every monitoring device on the 2-wire bus. One must consider that the number and type of monitoring devices on-line on a 2-wire bus will impact this balance.

It is understood that the scope of the present invention is not to be limited by the exact circuitry of the drawings, nor by the specific component values or specifications; rather, modifications and alterations which perform the functions as described above are within the scope of the present invention.

Example operation. In an effort to provide a more clear understanding of the method and apparatus of the present invention, the following example (scenario) of operation is provided with reference to the drawings and assuming the component values and specifications to be those of Attachment I: a nursing home facility is set up in which there are 200 apartments within a high-rise facility. The facility is either a newly constructed facility or an existing facility. In either event, the facility is wired for its normal telephone service with 4-wire telephone cable. Two wires of the 4-wire cable are used to connect normal telephone service from a central telephone room to each of the apartments. Therefore, two wires of the 4-wire telephone cable remain unused for telephone service. Since the example embodiment is a low voltage, low current system, the remaining 2-wires of the telephone cable will function nicely as the 2-wire bus 23. In this, stated example, each apartment, together with a limited portion of the adjacent hallway, comprises a monitored sector 12 of the present invention. The telephone room, or an adjacent communication room represent a common communication center 14. The two wires of the 4-wire telephone cable which are unused for telephone service represent the 2-wire buses 23 which are associated with each of the monitored sectors 12. Since telephone service typically runs from the telephone room, seperately, to each apartment, there is already a separate 2-wire bus running from the communication center 14 to each apartment (monitored sector) 12. A cluster of monitoring devices 13 is set up in each of the monitored sectors. For example, perhaps there is a toilet flushing monitor 21 in each apartment, a door movement monitor 20 attached to the front door of each apartment and a smoke monitor 16 placed in each apartment near the kitchen. Each of these devices is connected, in parallel to one another, to the respective 2-wire bus 23 associated with the particular apartment. For clarity, refer to FIGS. 1 and 2. In some, though perhaps not all, of the monitored sectors, an additional smoke monitor 16 is placed in the common hallway outside of the apartment and this smoke monitor is connected to the 2-wire bus servicing the adjacent apartment, in parallel to the other devices associated with that monitored sector (see for example monitored sector 12*c* or FIGS. 1 and 2). Also mounted in each apartment 12 is a radio receiver component 33 of a radio-linked alert monitor 18. The match code decoder chip 43 of each radio receiver 33 is programmed with a code which is different from the code of each and every other radio receiver within the facility. The resident of each apartment 12 is provided with a radio transmitter 32 (for example in the form of a pendant hanging about his/her neck) which radio transmitter is programmed to transmit a coded signal which code matches the program code of the radio receiver 33 in his/her apartment 12. Perhaps the facility has a nurse-call system which connects each apartment 12 to a nursing station down the hall. In this scenerio the relay output 55 of receiver 33 is connected to the nurse-call button within the respective apartment in order to act as a back-up system. At the communication center 14, one wire of each of the 2-wire buses 23 of each of the separate apartments 12 is connected to the positive terminal of the common power source 30. The negative return from each bus 23 is connected at a terminal block 74 after passing through its respective signal reflecting resistor 25. The output of the terminal block is tied to the negative terminal of the common power source 30. The communication center 14 is outfitted with signal identifiers 27 associated with each apartment (monitored sector) 12. The signal identifiers 27 utilized by this facility are similar to those described in relation to FIG. 6.

Figure 7:
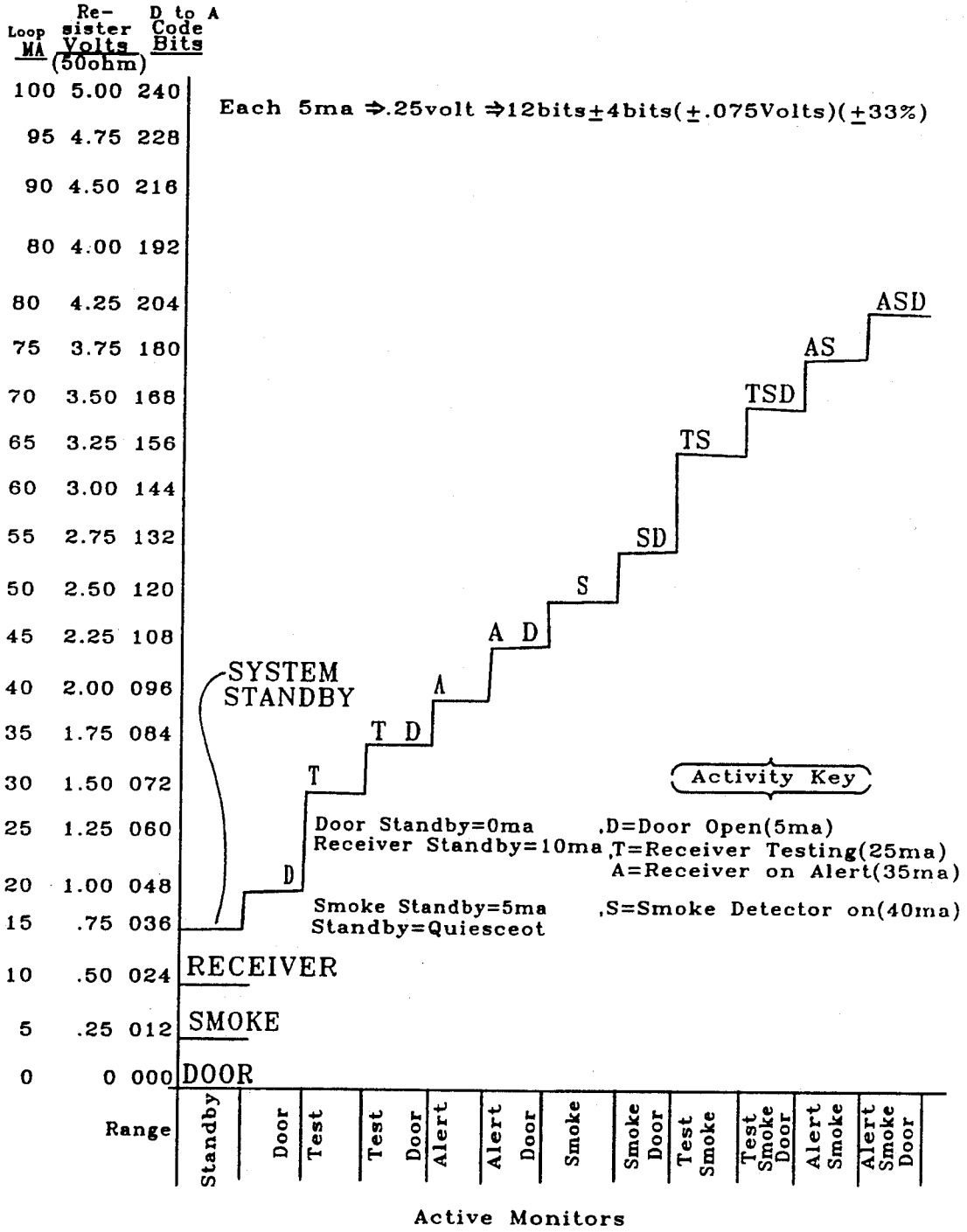
FIG. 7 is a graphic representation of signals generated by the monitoring system of the present invention.

With the apparatus of the present invention appropriately set up within the facility, the attendant (or a computer) continuously and simultaneously switches the switching interface 29 to selectively and alternately connect the output signals from one signal identifier 27 after the other to the guard device 31. The outputs being viewed are those at point "K", "L" and "M" from the respective signal identifier 27. The output from each apartment is, thus, connected to a recording, display, alarm and/or processing devices. Under normal conditions, there is an output of zero at the code decoder 76 output points "K" and "L" and the output from the A/D module 77 at point "M" is the digital representation of the quiescent voltage associated with the cluster of devices 13 on-line on the respective 2-wire bus 23. With reference to FIG. 7, it is seen that the quiescent output will vary depending upon which monitors are on-line. Thus, as the signal identifier outputs are alternately switched-in, if these normal outputs are observed, there is assumed to be no emergency conditions. However, should there be a shift in the output at point "M" of one of the signal identifiers 27, then a possible emergency condition is recognized and appropriate warnings or alarms are conveyed to the attendant at the communication center 14. Also, if a code appears at point "K" of one of the identifiers, without a corresponding shift in the output at point "M", a possible emergency condition is recognized, such as a passerby within a hallway or neighboring area or visitor to an apartment. The attendant can look at the output signals from points "K" and "L" and "M" to determine the nature and location of the possible emergency. For example, with reference to FIG. 7, the attendent can tell by the output level at point "M" which of the monitoring devices from the cluster of monitoring devices 13 has signaled a change in its condition. Thus, the attendant knows if a smoke monitor 16 has detected smoke or if a radio transmitter 32 has been activated. These are flagged as possible emergency conditions and assistance is dispatched. The attendants can also tell if a monitored activity has been performed such as opening the apartment door or flushing a toilet. This activity can be logged in by the attendant to provide some comfort that the resident of the respective apartment 12 is performing activity. If no such activity is noticed over, first example, a 12 hour period, the attendant can dispatch someone to check on the resident. As explained above, the attendant will know which monitored sector is experiencing the change in condition by observing which signal identifier 27 and, thus which 2-wire bus 23 carried the "condition change". In those monitored sectors where there is a smoke detector in the common hallway, the coded output at point "K" will distinguish the hallway smoke monitor from the kitchen smoke monitor. The facility will also be able to locate each of its residents anywhere in the facility, if that resident activates his/her radio transmitter 32. If, for example, a resident from a fifth floor apartment falls and is injured in the hallway on the second floor, that resident can activate his/her pendant transmitter 32 and the coded signal will be received by one or more of the radio receivers 33 in the apartments (sectors) 12 within the transmission range along the second floor. Thus, the attendant will note a change in condition signal, in the form of modulated current flow, conveyed along one, two or more of the 2-wire buses 23 from the second floor. The code corresponding to the pendant of the 5th floor resident will be carried along the 2-wire buses of the second floor apartments and will be output at points "K" of the various second floor signal identifiers 27, with no accompanying rise in the output level at points "M" of those same second floor apartments. Thus, the attendant will know that the particular fifth floor resident is in need of assistance on the second floor. Assistance is dispatched with prior knowledge of the medical history of that fifth floor resident.

The foregoing scenerio is by way of example only and it is understood that numerous combinations and permutations of apparatus arrangements and methods of operation are possible within the scope and spirit of the present invention.

Whereas, the alert monitor 18 of the present invention has been described with reference to a radio-linked embodiment, it is understood as being within the scope of the present invention that alternate embodiments of the alert monitor 18 include known transmitter devices 32 which transmit other modulated signals resulting from modulating pulses (ie, sound, infrared light) which modulated signals are received by an appropriate, known receiver module portion 36. The modulated signal is acted upon by the method and apparatus of the present invention, similarly to acting upon the radio signal, to deliver a representative signal along the 2-wire bus 23 to a signal identifier 27.

Whereas the present invention has been described in detail with specific reference to particular embodiments thereof, it will be understood that variations and modifications can be effected with the spirit and scope of the invention as described hereinbefore and as defined in the appended claims.

I claim:

1. A multi-condition monitoring system, comprising:

a plurality of indicator means for indicating the occurrence of multiple conditions, wherein each indicator means of said plurality of indicator means indicates the occurrence of at least one condition of said multiple conditions; each said indicator means changing from a non-triggered status to a triggered status upon occurrence of the respective condition;

a plurality of monitoring means for monitoring the status of said plurality of indicator means, wherein each monitoring means of said plurality of monitoring means monitors the status of at least one indicator means of said plurality of indicator means;

each said monitoring means comprising, at least, a detecting means for detecting said triggered status of the respective said indicator means, and a signal means for developing an identifying signal in direct response to detection of said triggered status by said detecting means;

each said monitoring means of said plurality of monitoring means requiring electric power for operation;

signal conditioning means for acting upon said identifying signal of each said monitoring means of said plurality of monitoring means to generate usable output;

power means for supplying operating power for each said monitoring means of said plurality of monitoring means;

a two conductor bus connecting said plurality of monitoring means to said power means and to said signal conditioning means, said two conductor bus carrying said identifying signals from all monitoring means of said plurality of monitoring means to said signal conditioning means and carrying said operating power from said power supply means to all said monitoring means of said plurality of monitoring means; and each said monitoring means being connected to said bus in series electrical relationship with said power means and said signal conditioning means and being connected to said bus in parallel electrical relationship with each of the other said monitoring means of said plurality of monitoring means.

2. System of claim 1, wherein said signal conditioning means comprises, at least, discriminating means for discriminating said identifying signal developed by each said monitoring means from said identifying signal developed by each other said monitoring means of said plurality of monitoring means.

3. System of claim 2, wherein said signal means of each said monitoring means comprises at least:

an impedance means for creating an impedence within a circuit; and switch means for connecting said impedance means to said two conductor bus in response to detection of said triggered status by said detecting means;

whereby said impedance is placed on said two conductor bus impacting current flow within said bus, said impacted current flow defining said identifying signal for the respective said monitoring means.

4. System of claim 3, wherein said impedance means of each said monitoring means is characterized by creation of an impedance differing from the impedence created by said impedance means of each other monitoring means of said plurality of monitoring means; and wherein said discriminating means comprises, at least, a resistance element positioned in said two conductor bus and a voltage processing device in parallel electrical relationship with said resistance element, said parallel combination of said resistor element and said voltage processing device being positioned in series electrical relationship with said impedance of each said impedance means, whereby each impedance effects a definable voltage drop across said resistance element.

5. System of claim 4, wherein said impedance means of each said monitoring means creates an impedance of predefined value.

6. System of claim 2, wherein said signal means of each said monitoring means of said plurality of monitoring means comprises at least:

pulse generating means for generating a pulsing signal in response to detection of said triggered status by said detecting means; and modulating means modulated by said pulsing signal for modulating current flow in said two conductor bus, said modulated current flow defining said identifying signal.

7. System of claim 6, wherein said discriminating means comprises resistance means positioned within the two wire bus for creating a voltage drop in response to said modulated current flow and a voltage processing means for processing said voltage; and wherein each said monitoring means of said plurality of monitoring means further comprises at least:

voltage regulating means for regulating voltage to said monitoring means as supplied by the two-conductor bus;

means associated with said voltage regulating means for defining on said bus a low impedance; and isolation means for isolating said low impedance from said modulating means.

8. System of claim 6, wherein said pulse generating means of each said monitoring means generates a pulsing signal defining a pre-assigned code, being a code pre-assigned to the respective said pulse generating means; and wherein said modulating means of each said monitoring means modulates current flow in said bus to effect a modulated current representing said code pre-assigned to the respective said pulse generating means; and wherein said discriminating means comprises, at least, decoder means for decoding said pre-assigned code as represented by said modulated current flow.

9. System of claim 1, wherein each indicator means of said plurality of indicator means indicates the occurrence of one of the following conditions: the presence of smoke; the presence of moisture; engaging of a signal transmitter activation trigger; motion in a sector; movement of an object such as, but not limited to, a door or toilet flush handle.

10. System of claim 9, wherein each indicator means of said plurality of indicator means indicates the occurrence of a condition different from that indicated by each of the other said indicator means.

11. System of claim 1, wherein a first indicator means of said plurality of indicator means comprises, at least, a radio transmitter activation trigger, whereby said first indicator means indicates the occurrence of engaging said trigger and said triggered status is defined as an engaged trigger; and wherein said detecting means of a first monitoring means comprises, at least, a radio transmitter activation switch circuit detecting the engaging of said trigger by closing of a switch to complete a circuit; and wherein said signal means of said first monitoring means comprises, at least, a radio transmitter means activated by said activation switch circuit for generating a radio signal, a radio receiver means for receiving said radio signal and converting said received radio signal to an electrical signal, and means for affecting current flow within said two conductor bus in response to said converted electrical signal, said affected current flow defining said identifying signal.

12. System of claim 11, wherein said means for affecting current flow comprises, at least:

an impedence means for creating an impedance within a circuit; and switch means for connecting said impedance means to said two conductor bus in response to detection of said converted electrical signal;

whereby said impedance is placed on said two wire bus impacting current flow within said bus, said impacted current flow defining said identifying signal for said first monitoring means.

13. System of claim 11, wherein said means for affecting current flow comprises, at least:

pulse generating means for generating a pulsing signal in response to detection of said triggered status by said detecting means; and modulating means modulated by said pulsing signal for modulating current flow in said two conductor bus, said modulated current flow defining said identifying signal for said first monitoring means.

14. System of claim 1, wherein each detecting means of said plurality of detecting means comprises, at least, the closing of a normally open switch.

* * * * *